US006047434A

United States Patent [19]

Falwell

[11] Patent Number: 6,047,434

[45] Date of Patent: Apr. 11, 2000

[54] MACHINE-WASHABLE CLEANING SLIPPER

[75] Inventor: Maureen Diane Falwell, Cincinnati, Ohio

[73] Assignee: Maureen D Falwell, Cincinnati, Ohio

[21] Appl. No.: 09/218,756

[22] Filed: Dec. 22, 1998

Related U.S. Application Data

[60] Provisional application No. 60/071,634, Jan. 16, 1998.

[51] Int. Cl.[7] ..... A47L 13/20; A47L 13/282

[52] U.S. Cl. ..... 15/227; 2/239; 36/9 R; 36/113

[58] Field of Search ..... 15/227; 2/239, 2/240; 36/7.1 R, 7.3, 7.4, 7.7, 9 R, 10, 59 R, 59 C, 113

[56] References Cited

U.S. PATENT DOCUMENTS

| | | | |
|---|---|---|---|
| 2,581,728 | 1/1952 | Spack | 36/9 R |
| 2,738,533 | 3/1956 | Peterson | 15/227 |
| 2,784,436 | 3/1957 | Peterson | 15/227 |
| 3,362,775 | 1/1968 | Muecke | 15/227 X |
| 3,526,014 | 9/1970 | Edwards | 15/227 |
| 3,528,120 | 9/1970 | Lindstrom | 15/227 X |
| 4,489,510 | 12/1984 | Williams | 36/59 C |
| 4,523,347 | 6/1985 | Tames | 15/104.94 |
| 4,697,295 | 10/1987 | Garrison | 15/227 |
| 5,092,347 | 3/1992 | Shaffer et al. | 36/9 R X |
| 5,173,985 | 12/1992 | Palmer | 15/227 |
| 5,280,664 | 1/1994 | Lin | 15/247 |
| 5,644,813 | 7/1997 | Puskas | 15/227 |

FOREIGN PATENT DOCUMENTS

| | | | |
|---|---|---|---|
| 2619998 | 3/1989 | France | 36/7.1 R |
| 450746 | 7/1936 | United Kingdom | 36/9 R |

*Primary Examiner*—Mark Spisich

[57] ABSTRACT

A machine washable cleaning slipper (10) comprised of an elastic structure (14) for securing the cleaning slipper (10), an upper covering structure (12) of machine washable material to protect the wearers foot from water, a cleaning component (15) made of absorbent machine washable materials fastened to the bottom of upper structure (12) with machine washable stitching (17), and upper absorbent panels (16) fastened to the sides and front top of upper structure (12) to provide cleaning abilities for floor boards and corners while protecting the wearer's foot and toes from water.

1 Claim, 4 Drawing Sheets

MACHINE-WASHABLE CLEANING SLIPPER

CROSS REFERENCE TO RELATED APPLICATION

This application claims the benefit of Provisional Patent Application number 60/071,634 filed Jan. 16, 1998.

FIELD OF THE INVENTION

This invention relates generally to foot floor cleaning devices and more specifically it relates to a machine washable slipper to be used either to dry the floor after mopping, or to clean or dust dry floors.

DESCRIPTION OF PRIOR ART

A wide variety of household cleaning devices are well known in the art for use in performing traditional household cleaning tasks. For example, U.S. Pat. No. 5,173,985 to Palmer, U.S. Pat. No. 5,644,813 to Puskas; U.S. Pat. No. 4,697,295 to Garrison; U.S. Pat. No. 4,523,347 to Tames; U.S. Pat. No. 5,280,664 to Lin; and U.S. Pat. No. 3,526,014 to Edwards are all illustrative of prior art. While these units may be suitable for the purposes for which they were designed, they would not be suitable for the purposes of the present invention. Several types of floor scouring devices have been proposed—for example, U.S. Pat. No. 5,173,985 to Palmer. These devices are not meant to be absorbent and may cause damage to softer materials such as modern linoleum. Other cleaning devices for applying cleaning solutions to the floor have been proposed—for example, U.S. Pat. No. 5,644,813 to Puskas. These devices serve as substitutes for broom handle style mops and are not designed to remove remaining solutions or for dusting dry floors.

3. Objects and Advantages

OBJECTS AND ADVANTAGES

Several objects and advantages of the present invention are to provide a foot mounted:

(a) cleaning device (b) drying device (c) sweeping or dusting device (d) cleaning device that is economical (e) cleaning device that is simple to use (f) cleaning device that is machine washable (g) cleaning device that is machine dryable Specifically, the present invention is designed to solve the problem of sticky floors left after mopping caused by remaining liquid cleaning solutions. Additionally, the soft bottom of the present invention allows it to be used as a foot attached dust mop for surfaces such as hardwood floors. The present invention is also set apart from previous art in that it is fully machine washable requiring the no more care than the average household towel.

Further objects and advantages of the present invention will become apparent from a consideration of the drawings and ensuing description.

DESCRIPTION OF DRAWINGS

The accompanying drawings illustrate the invention. In such drawings.

DETAILED DESCRIPTION OF THE PREFERRED EMBODIMENTS

Figure 1:
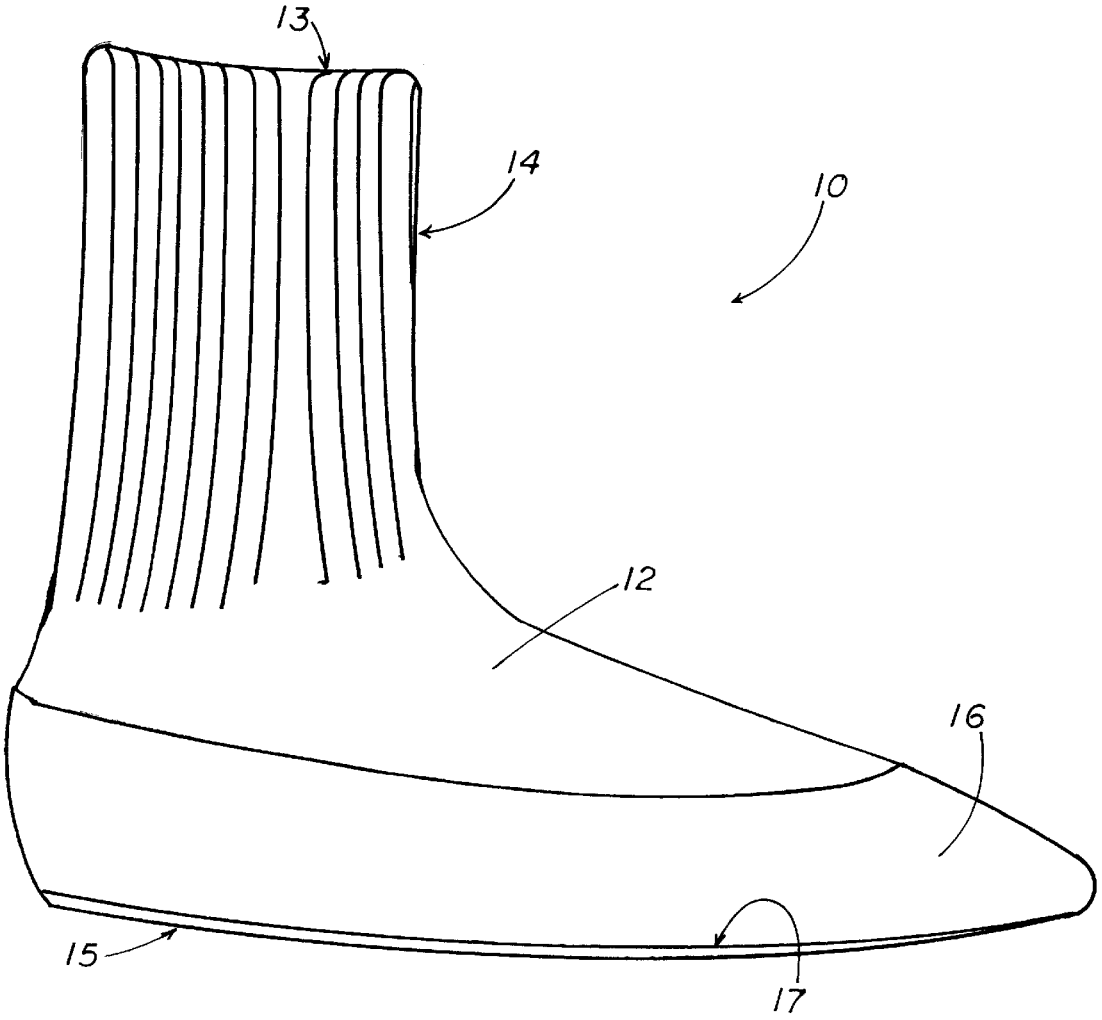
FIG. 1 is a side plan view of the present invention
Figure 2:
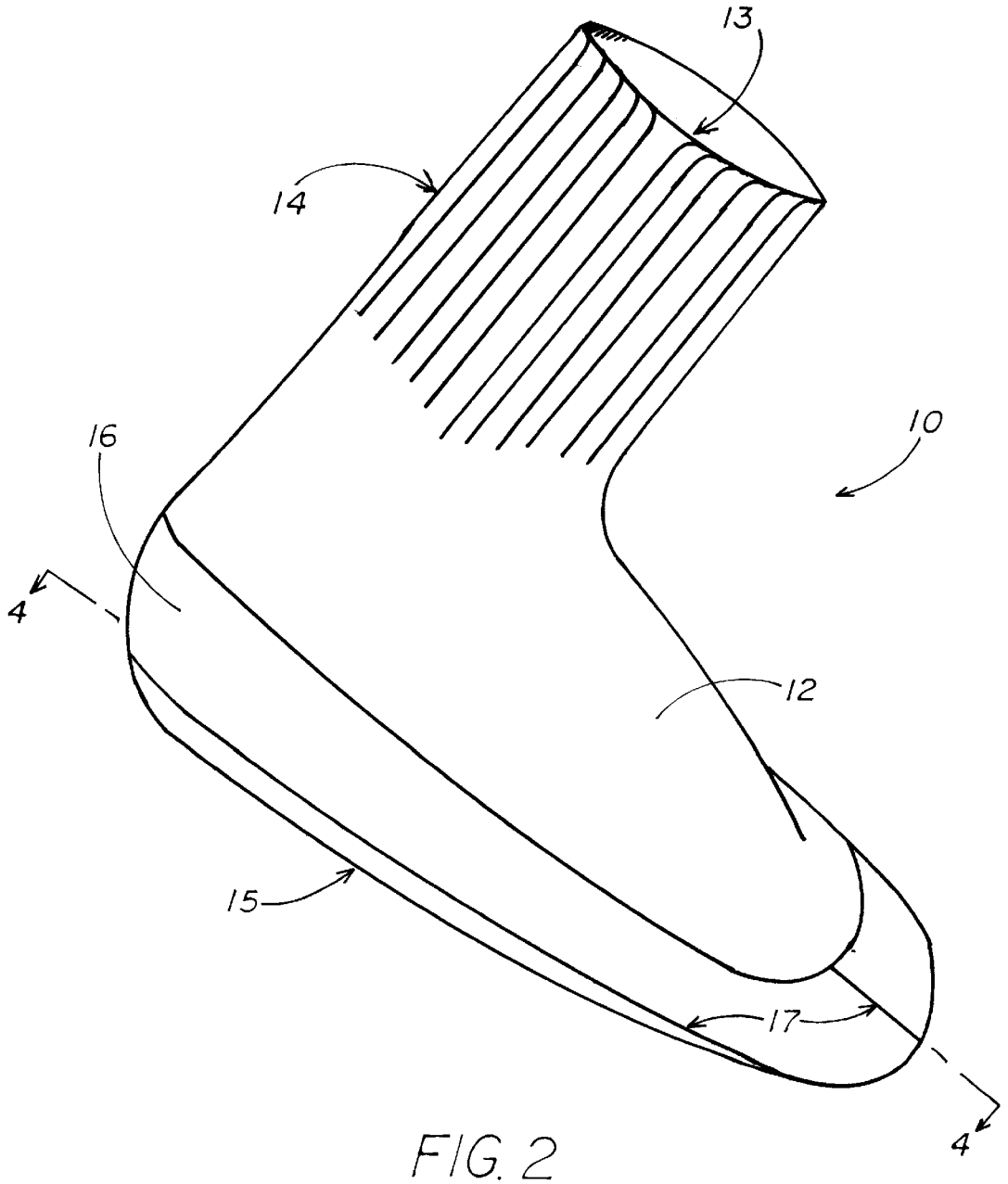
FIG. 2 is a front perspective view of the present invention
Figure 3:
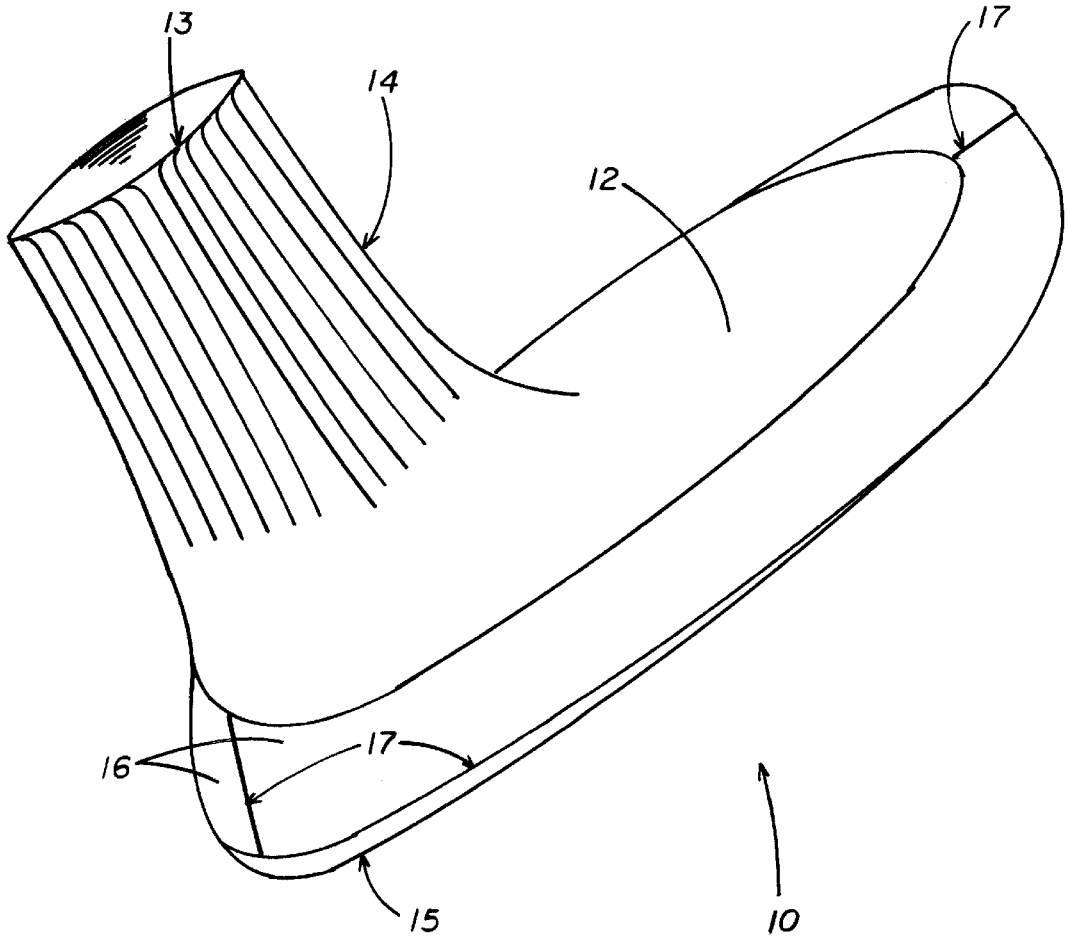
FIG. 3 is a rear perspective view of the present invention
Figure 4:
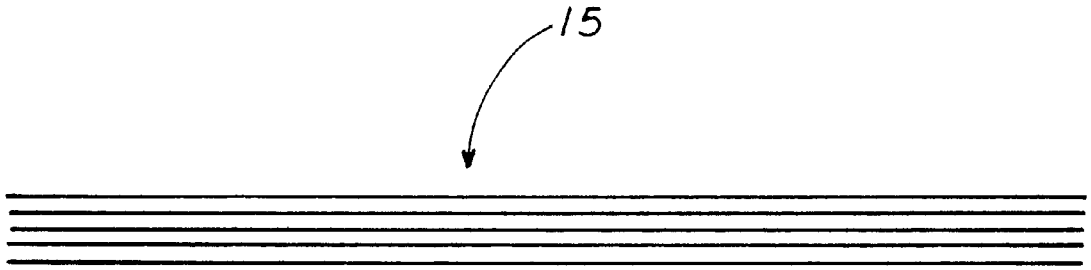
FIG. 4 is a cross-sectional view of the cleaning component 15 taken along line 4—4 in FIG. 2

A typical embodiment of the cleaning slipper 10 is shown in FIG. 1 through FIG. 4. The figures illustrate the cleaning slipper 10 comprised of an entrance aperture 13 provided in an elastic structure 14 for the insertion of the foot. Elastic structure 14 is made of an absorbent machine washable material and is connected to the top of upper structure 12. Upper structure 12 is also made of an absorbent machine washable material for covering the foot of the wearer, so as to protect the wearer from water. Elastic structure 14 and upper structure 12 are integrated and manufactured to fit generally the shape of a human ankle and foot. Elastic structure 14 secures the cleaning slipper 10 to the wearer and provides enough elasticity to hold the cleaning slipper 10 to the wearer even when wet.

A component 15 is attached to the bottom of upper structure 12, for cleaning the floor and absorbing moisture. Absorbent cleaning component 15 is made of fully machine washable materials, layered together in several plies. Absorbent cleaning component 15 being made of fully machine washable materials will not make marks or prints on floors. Upper absorbent panels 16 are attached to upper structure 12 in a location so that they encircle upper structure 12 while touching the upper edge of absorbent cleaning component 15. Upper absorbent panels 16 are made of a double ply of the same machine washable material as absorbent cleaning component 15. Upper absorbent panels 16 provide absorbency along the side of the wearers foot and across the front and tops of the wearers toes, thus making the cleaning slipper 10 effective for drying or dusting floor boards and corners.

All components are fastened together with machine washable stitching 17 to increase the durability of the cleaning slipper 10. All materials selected will allow the cleaning slipper 10 to be machine dried with out damaging the durability and to increase the quick return to service.

Reference Numbers In Drawings

10 Machine Washable Cleaning Slipper

12 upper covering structure of 10

13 entrance aperture in 14

14 elastic supporting structure of 10

15 absorbent cleaning component of 10

16 absorbent panels for side and front of 12

17 machine washable stitching used to hold all components together, not previously knitted as one unit Summary A machine washable cleaning slipper 10 comprised of an elastic structure 14 for securing the cleaning slipper 10, an upper covering structure 12 of machine washable material to protect the wearers foot from water, a cleaning component 15 made of absorbent machine washable materials fastened to the bottom of upper structure 12 with machine washable stitching 17, and upper absorbent panels 16 fastened to the sides and front top of upper structure 12 to provide cleaning abilities for floor boards and corners while protecting the wearer's foot and toes from water.

Operation of the Invention

To use the machine washable cleaning slipper 10, the following steps should be taken:

1. Pull the elastic supporting structure 14 over the foot of the wearer by first slipping the foot into the entrance aperture 13.

2. Repeat step 1 for the other foot.

3. If to be used to dry a mopped floor, wear the cleaning slipper 10 while mopping the floor and, after working the mop over an area of floor, step into the area and move feet in circular motions while touching the floor. Alternatively, the cleaning slipper 10 can be used after the entire floor has been mopped by then walking and dragging your cleaning slipper 10 clad feet around on the floor.

4. If to be used to dust or clean a dry floor, just wipe your cleaning slipper 10 clad feet around the floor in cleaning motions similar to those used by dust rags or brooms.

5. If the cleaning slipper 10 is to be used to dry or clean baseboards, the upper absorbent panels 16, located on the sides and front top of the cleaning slipper 10, should be wiped along the baseboard by the cleaning slipper 10 clad feet.

The cleaning slipper 10 can be used for other cleaning operations, just for keeping the wearer's feet dry while walking through a damp area of the house, or even just for comfortable leisure wear.

Conclusion, Ramifications, and Scope of Invention

Thus the reader can see that the cleaning slipper 10 provides many advantages over conventional floor drying after mopping, as well as floor dusting. By eliminating the need to hand dry a floor the user is allowed to stand upright and prevent back and knee pain. Drying the floor after mopping is necessary to eliminate the post mopping stickiness from left over floor cleaning soap residue. The easy use of the cleaning slipper 10 allows it to be used by persons of any age or physical size.

While the above description contains many specificities, these should not be construed as limitations on the scope of the invention, but rather as an exemplification of one preferred embodiment thereof. Many other variations are possible. For example the ribbed elastic structure 14 could be replaced with other fasteners and the elastic structure 14 can vary in size. Also, the upper absorbent panels 16 can be fashioned in different curvatures or with varying thicknesses, as can the layers or number of plies in the cleaning component 15, etc. Additionally, the entire cleaning slipper 10 can be made in various sizes.

Thus the scope of the invention should be determined by the appended claims and their legal equivalents, rather than by the examples given.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details for the device illustrated and in its operation can be made by those skilled in the art without departing in any way from the spirit of the present invention.

Without further analysis, the foregoing will so fully reveal the gist of the cleaning slipper 10 that others can, by applying current knowledge, readily adapt it for various applications without omitting features that, from the standpoint of prior art, fairly constitute essential characteristics of the generic or specific aspects of this invention.

What is claimed is:

1. A cleaning slipper comprising:

(a) a stretchable sheath of machine washable material for completely covering and snugly fitting on a user's foot to above the ankle, said sheath including an upper covering structure for covering the user's foot below the ankle, an elastic structure extending from the upper covering structure starting below the ankle and passing over the ankle to secure the sheath to the user's foot during use thereof and an entrance aperture through which the user's foot may be inserted therethrough, (b) a bottom cleaning component of machine washable absorbent material, said bottom cleaning component being stitched to and covering the bottom surface of the upper covering structure for cleaning a floor; and (c) side panels of machine washable absorbent material, said side panels being stitched to the upper covering structure such that they encircle the entire periphery thereof, said side panels extending from adjacent the bottom cleaning component towards an upper portion of the upper covering structure for cleaning floor boards and corners.

* * * * *